United States Patent [19]

Gleadall

[11] Patent Number: 5,075,921

[45] Date of Patent: Dec. 31, 1991

[54] WAND

[76] Inventor: Robert Gleadall, 3818 - 15 Avenue, Edmonton, Alberta, Canada, T6L 2M4

[21] Appl. No.: 696,217

[22] Filed: May 6, 1991

Related U.S. Application Data

[62] Division of Ser. No. 356,276, May 23, 1989.

[51] Int. Cl.[5] ..... A47L 9/32

[52] U.S. Cl. ..... 15/322; 15/410

[58] Field of Search ..... 15/321, 322, 410

[56] References Cited

U.S. PATENT DOCUMENTS

| | | | |
|---|---|---|---|
| 1,012,195 | 12/1911 | English | 15/410 |
| 1,403,261 | 1/1922 | Lynn | 15/410 X |
| 2,056,850 | 10/1936 | Gaughnour | 15/410 X |
| 2,660,457 | 11/1953 | Mallon | 15/410 X |
| 3,204,272 | 9/1965 | Greene et al. | 15/410 X |
| 3,371,371 | 5/1968 | Steccone | 15/410 X |
| 3,848,291 | 11/1974 | Morse | 15/410 X |
| 4,146,944 | 4/1979 | Pinto | 15/321 |
| 4,662,026 | 5/1987 | Sumerau et al. | 15/410 X |
| 5,016,315 | 5/1991 | Bledso et al. | 15/410 |

*Primary Examiner*—Chris K. Moore

*Attorney, Agent, or Firm*—Davis, Bujold & Streck

[57] ABSTRACT

An improvement in a wand attachment for a carpet cleaning apparatus. These wand attachments generally consist of a shaft having a first end and a second end. A suction conduit is provided having a first end and a second end. The first end is disposed at the first end of the shaft such that a suction force is applied to a carpet. The second end is adapted for coupling to a suction motor of a carpet cleaning apparatus. The improvement consists of an articulated shaft having three sections pivotally connected. One of the pivotal connections is adjacent the first end of the shaft.

2 Claims, 2 Drawing Sheets

WAND

This is a divisional of copending application Ser. No. 07/356,276, filed on May 23, 1989.

The present invention relates to an improvement in a wand attachment for a carpet cleaning apparatus.

BACKGROUND OF THE INVENTION

Wand attachments are used to clean narrow or low areas where the main carpet cleaning apparatus will not fit. However, even wand attachments are not of assistance when a long low area is encountered. An example of a long low area where a wand will not reach is under a booth in a restaurant. Existing wand attachments will only reach a limited distance under the booth. To perform a thorough cleaning job the operator must get down on his hands and knees and complete the job with a hand tool.

SUMMARY OF THE INVENTION

What is required is an improvement in a wand attachment which permits the wand to reach under long low areas.

According to the present invention there is provided an improvement in a wand attachment for a carpet cleaning apparatus. These wand attachments generally consist of a shaft having a first end and a second end. A suction conduit is provided having a first end and a second end. The first end is disposed at the first end of the shaft such that a suction force is applied to a carpet. The second end is adapted for coupling to a suction motor of a carpet cleaning apparatus. The improvement is comprised of an articulated shaft consisting of three sections pivotally connected. One of the pivotal connections is adjacent the first end of the shaft.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
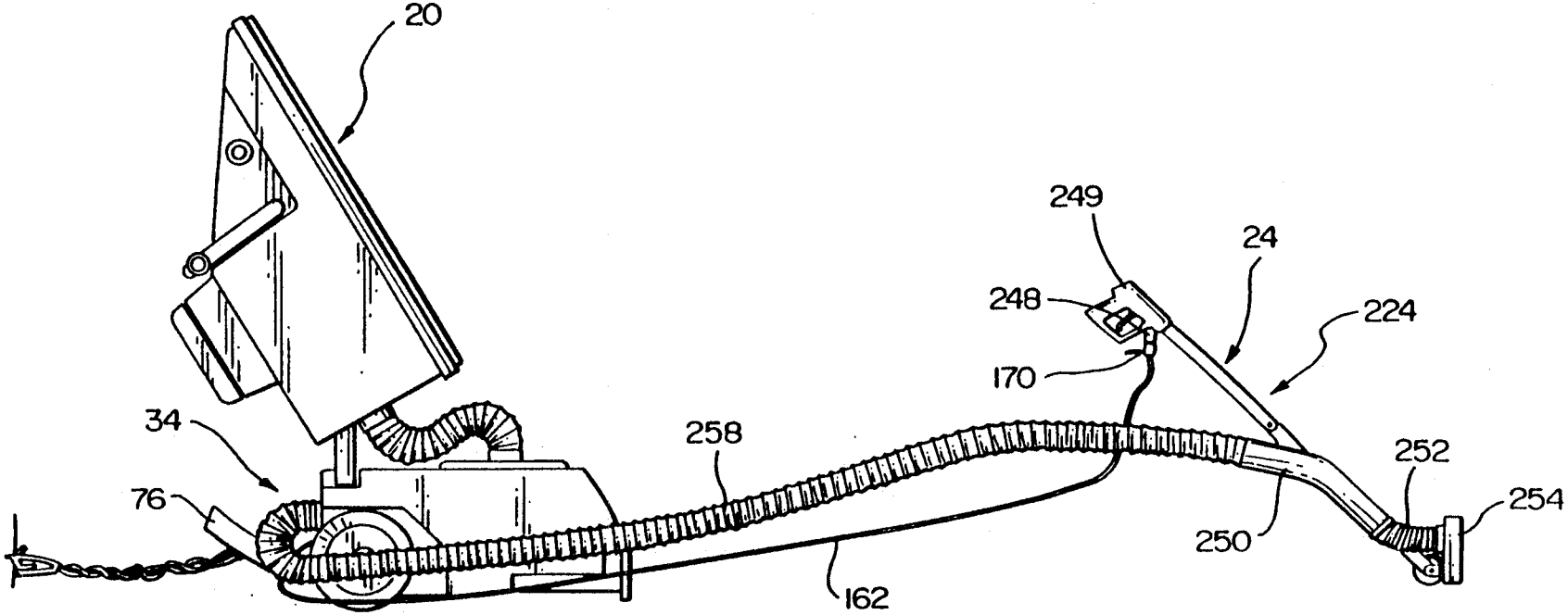
FIG. 1 is a side elevation view of a carpet cleaning apparatus utilizing a wand attachment constructed in accordance with the teachings of the present invention.
Figure 3:
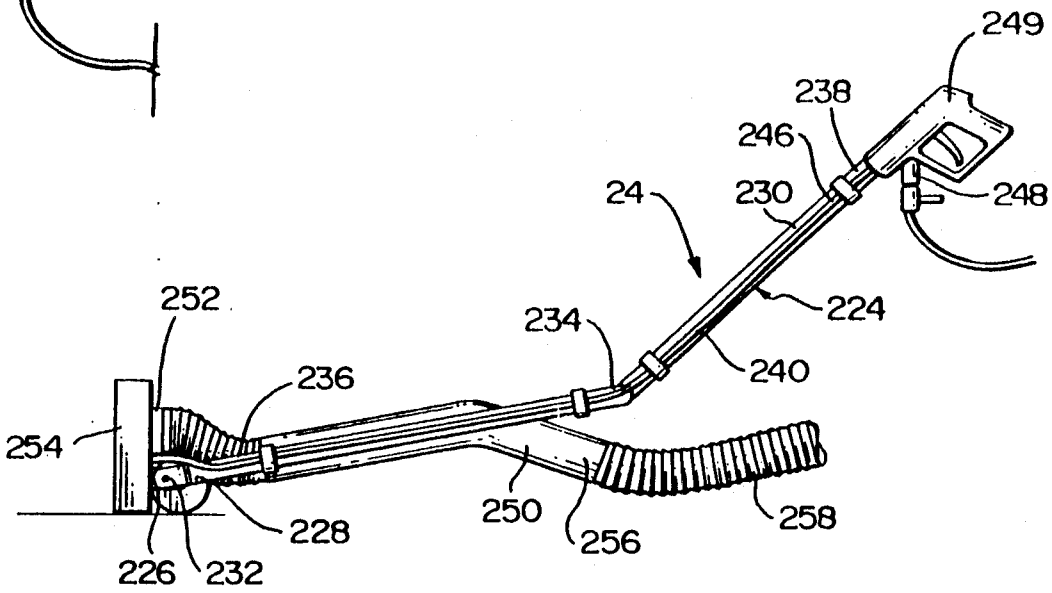
FIG. 3 is a side elevation view of the wand attachment illustrated in FIG. 1, in a second position.
Figure 2:
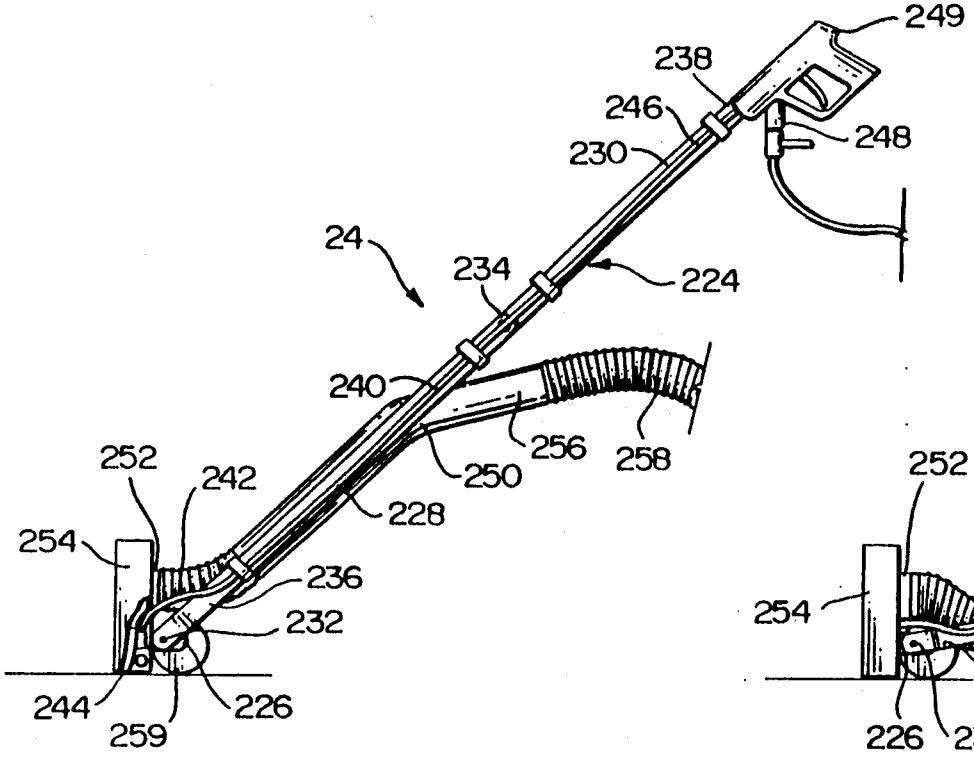
FIG. 2 is a side elevation view of the wand attachment illustrated in FIG. 1, in a first position.

The preferred embodiment will now be described with reference to FIGS. 1 through 3.

It will be apparent to one skilled in the art that a carpet cleaning apparatus 20 is well suited for cleaning open stretches of carpet, but it can not be used for cleaning under furnishings. For cleaning under furnishings a wand attachment 24 is provided, as illustrated in FIGS. 1 through 3. Wand attachment 24 consists of an articulated shaft 224. Shaft 224 has three sections 226, 228, 230. Section 226 is pivotally connected to section 228 at connection 232. Section 228 is pivotally connected to section 230 at connection 234. For the purpose of this description shaft 224 can be considered to have a first end 236 and a second end 238. Pivotal connection 232, connecting section 226 to section 228, is positioned adjacent first end 236 of shaft 224. Pivotal connection 234, connection section 228 to section 230, is spaced from second end 238 of shaft 224. A fluid conduit 240 is secured to shaft 224. Conduit 240 has a first end 242 at the first end 236 of shaft 224. Spray jets 244 are secured to end 242 of conduit 240. Conduit 240 has a second end 246 which has a coupling 248. Second 240 has a second end 246 which has a coupling 248. Second end 246 of conduit 240 has a hand control valve 249 to control the flow of fluids into conduit 240. A suction conduit 250 is secured to shaft 224. Suction conduit 250 has a first end 252 disposed at first end 236 of shaft 224. Suction conduit 250 has a second end 256 which may be attached to a length of vacuum hose 258. A sandwich blade 254 is secured to first end 236 of shaft 224. Sandwich blade 254 has positioned within it spray jets 244 and first end 252 of suction conduit 250. A pair of wheels 259 are rotatably mounted at first end 236 of shaft 224.

In order to use wand attachment 24, a door 76 at a back 34 of apparatus 20 must be opened to provide access to coupling connections. Vacuum hose 258 is secured to second end 256 of suction conduit 250. An end 170 of a water supply hose 162 must be connected to coupling 248 at second end 246 of conduit 240. By squeezing hand control valve 249 fluids are allowed to flow along conduit 240 to spray jets 244. As spray jets 244 are housed within sandwich blade 254, the operator need not worry about water splashing onto surrounding furnishings. Water is injected under pressure into the carpet. The suction force supplied by carpet cleaning apparatus 20 then draws the water from sandwich blade 254 into first end 252, along suction conduit 250, and then along the length of vacuum hose 258. The unique feature of wand attachment 24 is articulated shaft 224. Articulated shaft 224 can assume a number of positions to provide access to hard to reach places. FIG. 2 shows shaft 224 in a conventional position with joint 232 bent to place sections 226 and 228 at an angle with respect to each other while sections 228 and 230 remain aligned on a common plane. FIG. 3 shows shaft 224 in a position where it can reach underneath furnishings as joint 234 is bent to place sections 228 and 230 at an angle with respect to each other while sections 226 and 228 remain substantially aligned on a common plane. Joints 232 and 234 are sufficiently rigid that the sections of articulated shaft maintain their position until manipulated by the operator into such configuration as may be desired.

It will be apparent to one skilled in the art that modifications may be made to the preferred embodiment without departing from the spirit and scope of the invention as defined by the claims.

The embodiments of the invention in which an exclusive property or privilege is claimed are defined as follows:

1. An improvement in a wand attachment for a carpet cleaning apparatus, the wand attachment consisting of a shaft having a first end and a second end, a suction conduit having a first end disposed at the first end of the shaft such that a suction force is applied to a carpet, and a second end whereby the suction conduit may be coupled to a suction motor of a carpet cleaning apparatus, the improvement comprising:

said shaft being an articulated shaft consisting of three sections pivotally connected, one of the pivotal connections being adjacent the first end of the shaft.

2. The improvement as defined in claim 1, having a fluid conduit secured to the shaft, the fluid conduit having a first end at the first end of the shaft having a spray jets whereby fluids may be discharged onto a carpet and a second end whereby the fluid conduit may be coupled to a water supply hose.

* * * * *